United States Patent [19]

Hayashi et al.

[11] Patent Number: 4,577,594

[45] Date of Patent: Mar. 25, 1986

[54] COOLING SYSTEM FOR AUTOMOTIVE ENGINE

[75] Inventors: Yoshimasa Hayashi, Kamakura; Takao Kubozuka, Yokosuka; Yoshinori Hirano, Yokohama, all of Japan

[73] Assignee: Nissan Motor Co., Ltd., Yokohama, Japan

[21] Appl. No.: 704,269

[22] Filed: Feb. 22, 1985

[30] Foreign Application Priority Data

Feb. 23, 1984 [JP] Japan ..... 59-32994
May 18, 1984 [JP] Japan ..... 59-100157
May 18, 1984 [JP] Japan ..... 59-100155

[51] Int. Cl.[4] ..... F01P 11/02; F01P 3/22

[52] U.S. Cl. ..... 123/41.08; 123/41.21; 123/41.27; 123/41.44; 123/41.54

[58] Field of Search ..... 123/41.02, 41.08, 41.09, 123/41.1, 41.2, 41.21, 41.22, 41.23, 41.24, 41.25, 41.26, 41.27, 41.44, 41.54

[56] References Cited

U.S. PATENT DOCUMENTS

| | | | |
|---|---|---|---|
| 2,988,068 | 6/1961 | Waydak | 123/41.54 |
| 3,425,400 | 2/1969 | Scherenberg | 123/41.08 |
| 3,820,593 | 6/1974 | Pabst | 123/41.54 |
| 4,144,849 | 3/1979 | Dahm | 123/41.54 |
| 4,352,342 | 10/1982 | Cser et al. | 123/41.54 |
| 4,362,131 | 12/1982 | Mason et al. | 123/41.1 |
| 4,367,699 | 1/1983 | Evans | 123/41.54 |
| 4,473,037 | 9/1984 | Michassouridis et al. | 123/41.27 |

FOREIGN PATENT DOCUMENTS

| | | | |
|---|---|---|---|
| 4317136 | 7/1960 | Japan | 123/41.02 |
| WO80/863 | 5/1980 | PCT Int'l Appl. | 123/41.02 |

*Primary Examiner*—William A. Cuchlinski, Jr.
*Attorney, Agent, or Firm*—Schwartz, Jeffery, Schwaab, Mack, Blumenthal & Evans

[57] ABSTRACT

A vapor cooled type internal combustion engine is provided with an auxiliary reservoir and a coolant management system. The management system establishes fluid communication between the reservoir and a cooling circuit of the engine in a manner to fill the latter with liquid coolant when the engine is not in use and thus exclude contaminating non-condensible air from same, and monitors the operation of the system when operating in a closed mode to determine if too much or too little coolant has been retained in the circuit following a warm-up mode wherein the excess coolant which fills the system when cold, is displaced by its own vapor pressure. The management system also ensures that the cooling circuit is not switched from closed to open states while the possibility of superatmospheric pressures developing therein exist and thus prevents violent displacement of coolant out of the circuit to the reservoir in a manner which invites spillage of coolant and the entry of large amounts of contaminating air.

13 Claims, 18 Drawing Figures

CPU
RAM
ROM
I/O
I/O
180
182
184
100
104
106
120
120
121
122
124
126
127
128
130
132
132
134(II)
136
140
144
146
148
149
150
150
152(I)
162
163
164
168
170(III)
172
172
A
B
91
90
92
95
96
94
93

EXCESS COOLANT DISPLACEMENT ROUTINE

COOLING SYSTEM FOR AUTOMOTIVE ENGINE

BACKGROUND OF THE INVENTION

1. Field of the Invention

The present invention relates generally to a cooling system for an internal combustion engine wherein liquid coolant is boiled to make use of the latent heat of vaporization of the same and the vapor used as a vehicle for removing heat from the engine, and more specifically to such a system which includes a control arrangement which monitors and controls the amount of coolant retained in the cooling circuit under all modes of operation.

2. Description of the Prior Art

In currently used "water cooled" internal combustion engines such as shown in FIG. 1 of the drawings, the engine coolant (liquid) is forcefully circulated by a water pump, through a circuit including the engine coolant jacket and an air cooled radiator. This type of system encounters the drawback that a large volume of water is required to be circulated between the radiator and the coolant jacket in order to remove the required amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having 1800 cc displacement (by way of example) is operated at full throttle, the cooling system is required to remove approximately 4000 Kcal/h. In order to acheive this a flow rate of 167 Liter/min (viz., $4000-60\times\frac{1}{4}$) must be produced by the water pump. This of course undesirably consumes a number of otherwise useful horsepower.

FIG. 2 shows an arrangement disclosed in Japanese Patent Application Second Provisional Publication No. Sho 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangement has suffered from the drawbacks that the radiator, depending on its position with respect to the engine proper tends to be at least partially filled with liquid coolant. This greatly reduces the surface area via which the gaseous coolant (for example steam) can effectively release its latent heat of vaporization and accordingly condense and thus has lacked any notable improvement in cooling efficiency.

Further, with this system in order to maintain the pressure within the coolant jacket and radiator at atmospheric level, a gas permeable water shedding filter 5 is arranged as shown, to permit the entry of air into and out of the system. However, this filter permits gaseous coolant to gradually escape from the system, inducing the need for frequent topping up of the coolant level.

A further problem with this arrangement has come in that some of the air, which is sucked into the cooling system as the engine cools, tends to dissolve in the water, whereby upon start up of the engine, the dissolved air tends to form small bubbles in the radiator which adhere to the walls thereof forming an insulating layer.

The undissolved air tends to collect in the upper section of the radiator and inhibit the convection-like circulation of the vapor from the cylinder block to the radiator. This of course further deteriorates the performance of the device.

European Patent Application Provisional Publication No. 0 059 423 published on Sept. 8, 1982 discloses another arrangement wherein, liquid coolant in the coolant jackets of the engine, is not circulated therein and permitted to absorb heat to the point of boiling. The gaseous coolant thus generated is adiabatically compressed in a compressor so as to raise the temperature and pressure thereof and introduced into a heat exchanger. After condensing, the coolant is temporarily stored in a reservoir and recycled back into the coolant jacket via a flow control valve.

This arrangement has suffered from the drawback in that air tends to leak into the system upon cooling thereof. This air tends to be forced by the compressor along with the gaseous coolant into the radiator. Due to the difference in specific gravity, the air tends to rise in the hot environment while the coolant which has condensed moves downwardly. The air, due to this inherent tendency to rise, forms large bubbles of air which cause a kind of "embolism" in the radiator and badly impair the heat exchange ability thereof.

U.S. Pat. No. 4,367,699 issued on Jan. 11, 1983 in the name of Evans (see FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the "dry" gaseous coolant (steam for example) is condensed in a fan cooled radiator 8. The temperature of the radiator is controlled by selective energizations of the fan 9 to maintain a rate of condensation therein sufficient to sustain a liquid seal at the bottom of the device. Condensate discharged from the radiator via the above mentioned liquid seal is collected in a small reservoir-like arrangement 10 and pumped back up to the separation tank via a small pump 11.

This arrangement, while providing an arrangement via which air can be initially purged from the system tends to, due to the nature of the arrangement which permits said initial non-condensible matter to be forced out of the system, suffers from rapid loss of coolant when operated at relatively high altitudes. Further, once the engine cools air is relatively freely admitted back into the system. The provision of the separation tank 6 also renders engine layout difficult.

Japanese Patent Application First Provisional Publication No. Sho. 56-32026 (see FIG. 4 of the drawings) discloses an arrangement wherein the structure defining the cylinder head and cylinder liners are covered in a porous layer of ceramic material 12 and coolant sprayed into the cylinder block from shower-like arrangements 13 located above the cylinder heads 14. The interior of the coolant jacket defined within the engine proper is essentially filled with gaseous coolant during engine operation during which liquid coolant sprayed onto the ceramic layers 12. However, this arrangement has proved totally unsatisfactory in that upon boiling of the liquid coolant absorbed into the ceramic layers the vapor thus produced escaping into the coolant jacket inhibits the penetration of liquid coolant into the layers whereby rapid overheat and thermal damage of the ceramic layers 12 and/or engine soon results. Further, this arrangement is plagued with air contamination and blockages in the radiator similar to the compressor equipped arrangement discussed above.

U.S. Pat. No. 1,787,562 issued on Jan. 6, 1931 in the name of Barlow, teaches a vapor cooled type engine arrangement wherein a level sensor is disposed in the coolant jacket of the engine and arranged to control the operation of a coolant return pump. This pump is disposed in a small reservoir located at the bottom of the radiator or condensor in which the coolant vapor is condensed. A valve is arranged to vent the reservoir with the ambient atmosphere and thus maintain the interior of the radiator and coolant jacket at ambient atmospheric pressure under all operating conditions.

This arrangement sufferes from the drawbacks that the valve is located in a position which is too low to enable all of the air to be urged out of the system when the engine is started, and that desirable variation in the coolant boiling point with changes in engine load is not possible. Viz., due to the tendency for the air to rise, some air is always present even when the engine is warmed up and running and due to the maintainance of atmospheric pressure in the system boiling point reduction/elevation is not possible.

In summary although the basic concepts of open and closed "vapor cooling" systems wherein the coolant is boiled to make use of the latent heat of evaporation thereof and condensed in a suitable heat exchanger, is known, the lack of a control system which is both sufficiently simple as to allow practical use and which overcomes the various problems plauging the prior art is wanting.

SUMMARY OF THE INVENTION

It is an object of the present invention to provide a "vapor" type cooling system which can be completely filled with liquid coolant when "cold" (to exclude contaminating non-condensible atmospheric air during non-use) via placing a cooling circuit (coolant jacket, radiator and condensate return arrangemement) in fluid communication with an external reservoir, and which includes a management arrangement which monitors and appropriately controls the amount of coolant in the cooling circuit under all modes of operation.

Another object of the present invention is to provide a system of the nature indicated above wherein the boiling point of the engine coolant can be controlled in response to changes in engine operation.

In brief, the above objects are achieved by a vapor cooled type internal combustion engine which is provided with an auxiliary reservoir and a coolant management system. The management system establishes fluid communication between the reservoir and a cooling circuit of the engine in a manner to fill the latter with liquid coolant when the engine is not in use and thus exclude contaminating non-condensible air from same, and monitors the operation of the system when operating in a closed mode to determine if too much or too little coolant has been retained in the circuit following a warm-up mode wherein the excess coolant which fills the system when cold, is displaced by its own vapor pressure. The management system also ensures that the cooling circuit is not switched from closed to open states until predetermined temperature and pressure requirements are both met, and thus prevents violent displacement of coolant out of the circuit to the reservoir in a manner which invites spillage of coolant and the entry of large amounts of contaminating air.

An embodiment of the invention features control circuit including a microprocessor (or the like) which is arranged to selectively induce:

a non-condensible purge mode—wherein excess coolant is pumped into the cooling system to overfill same and thus displace any air or like non-condensible matter;

an excess coolant displacement mode—wherein the coolant and engine are rapidly warmed due to the system being completely filled with liquid coolant (which inhibits heat exchange with the ambient atmosphere) and wherein the vapor produced by the heating is used to displace excess coolant from the system until the amount required for normal operation remains;

a normal operation mode—wherein the cooling circuit is placed in a closed condition and the temperature of the engine is controlled by controlling the rate of condensation of vapor (generated in the coolant jacket) in the radiator with respect to engine load etc.;

a retained coolant check/control mode—wherein data derived by monitoring the temperature of the coolant, the operation of a coolant return pump and the outputs of level sensors disposed in the coolant jacket and at the bottom of the radiator, the presence of excess coolant and/or the lack of thereof within the system when conditioned to assume a closed condition, is determined and the appropriate correction undertaken;

an overcooled control mode—wherein the radiator is partially filled with liquid coolant in order to reduce the effective heat exchange surface area thereof and thus prevent excessively low temperatures and pressures from prevailing within the system when the pressure within the system is below ambient atmosphere and the coolant temperature below a predetermined target valve by respective preset values; and a system shut-down mode—wherein the coolant temperature and pressure within the system are quickly reduced by briefly continuing the use of a cooling device (e.g. fan) until both the temperature and pressure in the "cooling circuit" to levels which eliminates any positive pressure which tends to displace overly large amounts of coolant out of the system to an externally disposed coolant reservoir, upon the system being switched from a closed state to an open one.

The two latter mentioned modes allow the size of the reservoir to be minimized and thus an overall reduction in the weight of the system.

In more specific terms a first aspect of the present invention takes the form of a cooling system for an internal combustion engine which system comprises: a coolant jacket formed about structure of the engine subject to high heat flux; a radiator in which coolant vapor is condensed to its liquid form; a vapor transfer conduit leading from the coolant jacket to the radiator; means for returning liquid coolant from the radiator to the coolant jacket in a manner to maintain the structure subject to high heat flux immersed in liquid coolant and define a vapor collection space within the coolant jacket; a reservoir containing liquid coolant; valve and conduit means for selectively establishing fluid communication between the coolant jacket and the reservoir; and valve and conduit control means including circuitry for: (a) conditioning the valve and conduit means so as to establish fluid communication between the reservoir and a cooling circuit which includes the coolant jacket, the radiator and the second vapor transfer conduit, when the temperature of the coolant within the coolant jacket is below a first predetermined level and the pressure prevailing within the cooling circuit is below ambient atmospheric pressure by second predetermind value; (b) conditioning the valve and conduit means so as to introduce excess coolant from the reservoir into the cooling circuit when the engine is started and the temperature of the coolant in the coolant jacket is below a third predetermined level and thus purge out any non-condensible matter in the cooling circuit; (c) conditioning the valve and conduit means so as to permit coolant to be displaced from the engine under the influence of the vapor pressure produced within the cooling circuit when the engine is running and the temperature of the coolant is above the third predetermined level, and for terminating the displacement when the liquid coolant returning means indicates that amount of coolant contained in the cooling circuit has been reduced to a predetermined desired level; and (d) monitoring the operation of the liquid coolant returning means to determine if the correct amount of coolant has been retained in the cooling circuit and for conditioning the valve and conduit means to permit correction of the amount of coolant to the desired level in the event that the monitoring indicates same to be necessary.

A second aspect of the invention takes the form of a method of cooling an internal combustion engine which comprises the steps of: introducing liquid coolant into a coolant jacket formed about structure of the engine subject to high heat flux in a manner to immerse the structure in a predetermined depth of liquid coolant; allowing the liquid coolant in the coolant jacket to boil; condensing the vapor produced by the boiling in the coolant jacket to its liquid form in a radiator; transferring the coolant vapor from the coolant jacket to the radiator using a vapor transfer conduit; returning liquid coolant from the radiator to the first coolant jacket using a coolant return arrangement in a manner to maintain the structure subject to high heat flux immersed in the predetermined depth of liquid coolant and define a vapor collection space within the coolant jacket; storing additional coolant in a reservoir; conditioning the valve and conduit means so as to establish fluid communication between the reservoir and a cooling circuit which includes the coolant jacket, the radiator and the second vapor transfer conduit, when the temperature of the coolant within the coolant jacket is below a first predetermined level and the pressure prevailing within the cooling circuit is below ambient atmospheric pressure by a second predetermined amount; conditioning the valve and conduit means so as to introduce excess coolant from the reservoir into the cooling circuit when the engine is started and the temperature of the coolant in the coolant jacket is below a third predetermined level and thus purge out any non-condensible matter in the cooling circuit; conditioning the valve and conduit means so as to permit coolant to be displaced from the engine under the influence of the vapor pressure produced within the cooling circuit when the engine is running and the temperature of the coolant is above the third predetermined level, and for terminating the displacement when the amount of coolant contained in the cooling circuit has been reduced to a predetermined desired level; monitoring the operation of the liquid coolant returning arrangement to determine if the correct amount of coolant has been retained in the cooling circuit; and correcting the amount of coolant retained in the cooling circuit in the event that the step of monitoring reveals that the amount of coolant retained in the cooling circuit is not at a desired level.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Before proceeding with the description of the actual embodiment of the present invention, it is deemed advantageeous to firstly discuss some of the concepts on which the present invention is based.

Figure 6:
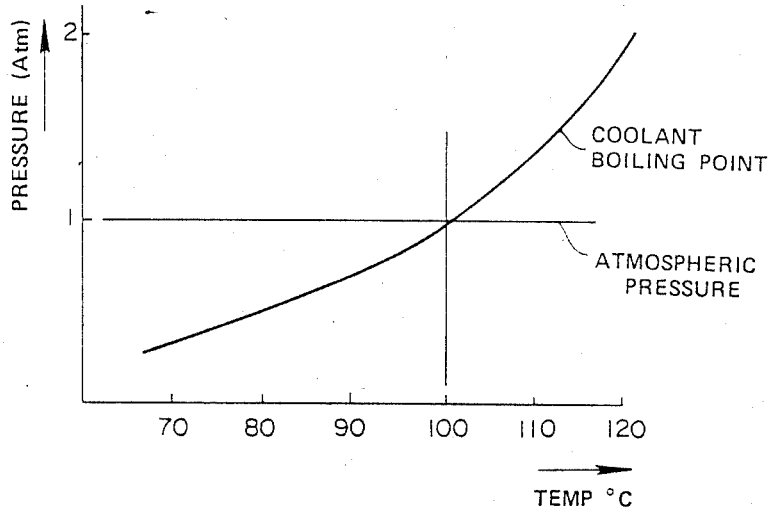
FIG. 6 is a graph showing, in terms of pressure and temperature, the change which occurs in the coolant boiling point with change in pressure.

FIG. 6 graphically shows, in terms of engine torque and engine speed, the various load "zones" which are encountered by an automotive vehicle engine. In this graph, the the curve F denotes full throttle torque characteristics, trace L denotes the resistance encountered when a vehicle is running on a level surface, and zones I, II and III denote respectively what shal be referred to as "urban cruising", "high speed cruising" and "high load operation" (such as hillclimbing, towing etc.).

A suitable coolant temperature for zone I is approximately 110° C. while 100°-98° C. (for example) for zones II and III. The high temperature during "urban cruising" of course promotes improved fuel economy while the lower temperatures promote improved charging efficiency while simultaneously removing sufficient heat from the engine and associated structure to obviate engine knocking and/or engine damage in the other zones.

With the present invention, in order to control the temperature of the engine, advantage is taken of the fact that with a cooling system wherein the coolant is boiled and the vapor used a heat transfer medium, boiling is most vigorous in zones of high heat flux, whereby the temperature of engine structure subject to high heat flux is maintained essentially equal to that of structure subject to less intensive heating whereat boiling is less vigorous and less heat removed; the amount of coolant actually circulated between the coolant jacket and the radiator is very small; the amount of heat removed from the engine per unit volume of coolant is very high; and upon boiling, the pressure prevailing within the coolant jacket and consequently the boiling point of the coolant rises if the system employed is conditioned to assume a "closed" condition. Thus, by circulating a controlled amount of cooling air over the radiator, it is possible to quickly reduce the rate of condensation therein and cause the pressure within the cooling system to rapidly rise above atmospheric and thus induce the situation, as shown in FIG. 7, wherein the engine coolant boils at temperatures above 100° C.—for example at approximately 110° C.

On the other hand, during high speed cruising, it is further possible by increasing the flow of cooling air passing over the radiator (for example by energizing a cooling fan and/or by appropriately using the natural draft of air which occurs under such conditions) to quickly increase the rate of condensation within the radiator to a level which rapidly reduces the pressure prevailing in the cooling system below atmospheric and thus induces the situation wherein the coolant boils at temperatures at or below 100° C.

Figure 7:
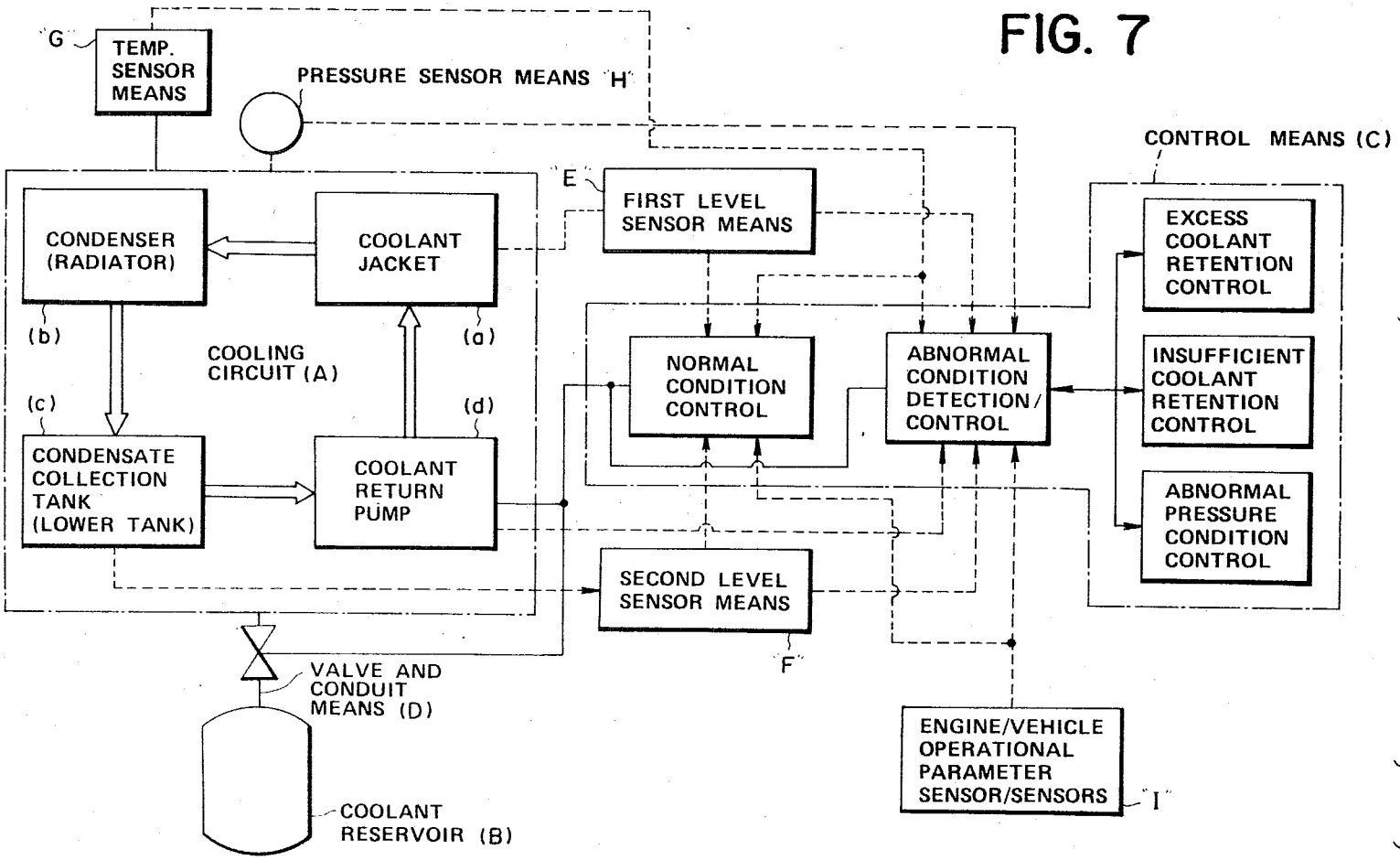
FIG. 7 shows in schematic block form the system which characterizes the present invention.

FIG. 7 shows in schematic block diagram form a systematic representation of the present invention. In this diagram the present invention is depicted as including three major sections. Viz., a cooling circuit (A), a reservoir (B) and a control means (C).

The first of these elements, (viz., "cooling circuit" (A)) includes (a) a coolant jacket formed about portions of the engine which are subject to high heat flux and in which coolant is permitted to boil, (b) a condensor in which the vapor produced by the boiling of the coolant in the coolant jacket is condensed back to its liquid state (this element although not shown includes a cooling fan or like device for assisting heat exchange between the condensor and the ambient atmosphere), (c) a condensate collection tank which is disposed at the bottom of the radiator and arranged to collect the liquid coolant from the radiator, and (d) a coolant return pump which returns the liquid coolant from the collection tank back to the coolant jacket.

The cooling circuit (A) is arranged to fluidly communicate with the reservoir (B) through what shall be termed "valve and conduit means" (D) which is arranged to be controlled by the control means (C).

As shown (highly schematically), the control means (C) includes circuitry for (i) executing "normal condition control" and (ii) detecting and controlling the system in the event that an "abnormal condition" such as the inclusion of too much or too little coolant within the system or the occurrence within the cooling circuit of a sub-atmospheric pressure of a magnitude which is sufficiently low to lower the coolant boiling point to the degree of causing engine overcooling or worse, damage (crushing) to the cooling circuit itself.

First and second level sensors ("E" & "F") which sense the level of coolant in the coolant jacket, and the condensate collection tank, respectively, along with temperature and pressure sensor means ("G" & "H") the latter of which detects the presence of an abnormally low pressure (relative to the ambient atmospheric pressure) within the system; supply data to the control means (C) which in turn in response to same outputs the appropriate control to the condensor (b), return pump (d) and the valve and conduit means (D).

In brief, when the engine is cold (viz., the temperature of the engine coolant is below 75° C.—by way of example) and the pressure within the system less than atmospheric, the control means provides fluid communication between the cooling circuit (A) and the reservoir (B) and permits the cooling circuit to be completely filled with liquid coolant. This prevents the entry of contaminating atmospheric air. Upon engine start-up under such conditions, the control means (C) energizes the coolant return pump (d) while simultaneously conditioning the valve and conduit means (D) so that the pump (d) inducts coolant from the reservoir and pumps same into the cooling circuit to overfill same and thus purge out any non-condensible matter which might have found its way into the system. Subsequently, as the coolant temperature rises to the point of producing vapor pressure, the latter is used to displace coolant from the system back out to the reservoir until the first and second level sensors ("E" & "F") indicate that the levels of coolant in the coolant jacket (a) and the condensate collection tank (c) have reached appropriate predetermined levels. Upon this situation occuring the control means (C) conditions the valve and conduit means (D) to cut off fluid communication therethrough and place the cooling circuit in a "closed" state.

Depending on the input from an engine/vehicle operational parameter sensor or sensors ("I"), the control means operates the condensor according to a normal operation schedule so as to induce a rate of condensation therein which is suited to the given engine/vehicle operation.

During this "normal" operation, the operational characteristics of the coolant return pump (d), first and second level sensors ("E" & "F") and the pressure sensor means ("H") are periodically monitored and a determination made as to the existence of too much or too little coolant within the cooling circuit and/or an abnormal pressure prevailing therein.

This monitoring, in the embodiment of the present invention takes the form of (to determined the presence of excess coolant within the system) firstly adjusting the level of coolant in the coolant jacket (a) to the appropriate level and then, in the event that the level of coolant is above that of the second level senor ("F"), energizing the coolant return pump (d) to move the excess coolant from the condensate collection tank (c) to the coolant jacket (a) unil the level of coolant in the condensate coolection tank (c) falls to that of the second level sensor ("F"). The time required for this transfer is taken as a measure of how much excess coolant is retained within the cooling circuit. On the other hand, the time required in excess of a predetermined period for the coolant return pump (d) to establish the appropriate level of coolant in the coolant jacket can be taken as an indication that either an insufficient amount of coolant has been retained within the cooling circuit or alternatively that coolant has been lost from the system due to leakages or the like.

It will be appreciated that this periodic monitoring of the system operation is vital as it is possible that, due to malfunction of the level sensors, pump or, on the other hand, due to movement (e.g. sloshing) of coolant within the system, erroneous signals may be fed to the control means and an amount other than the appropriate one, retained within the system upon the change from open to closed states. The entrapment of too much coolant within the system can lead to partial flooding of the condensor (b) and an according reduction in heat exchange efficiency. This, under certain circumstances can lead to overheating of the engine due to the inability of the cooling system to release sufficient heat to the ambient atmosphere. On the other hand, placing the system in a closed state with insufficient coolant retained therein can prevent the structure of the engine such as the cylinder head exhaust ports and valves etc., which are subject to high heat flux, from being immersed in sufficient coolant to ensure that localized dry-outs (which lead to the formation of hot spots which subsequently tend to perpetuate the dry-out) and subsequent thermal damage to the engine do not occur.

Moreover, with the system of the present invention, it is deemed necessary to sense both the coolant temperature and presssure within the cooling circuit before switching the system from closed to open states in the event that overcooling of the engine is taking place (due to prolonged downwhill coasting for example) and it is necessary to partially fill the condensor with liquid coolant in order reduce the heat exchange efficiency thereof and enable the engine temperature to be increased back up to a desirable level. The reason for this being that, in the event the engine is being operated at relatively high altitudes such as occur on mountains and the like, even if the coolant temperature has fallen below the normal boiling point (i.e. the BP under 1 atmosphere) if temperature alone is used a parameter for determining when the cooling circuit is switched from a closed state to an open one, still the possibility of a super-atmospheric pressure prevailing within the system exists and accordingly the possibility that this pressure may cause a violent displacement of coolant out of the cooling circuit to the reservoir. This of course induces the possibility that coolant will lost permanently via spillage and/or air will be permitted to enter the system in relatively large quantities.

Further, when anti-freeze or similar solutions which change the boiling point of the coolant, are used, due to the elevation in boiling point of the coolant due to the additives it is impossible to reduce the boiling point of the coolant to 100° C. for example, without the system being in a closed state and the pressure within the cooling circuit below atmospheric. Accordingly, with present invention in order to achieve reliable control of the system, both temperature and pressure are taken into account.

Figures 8, 9:
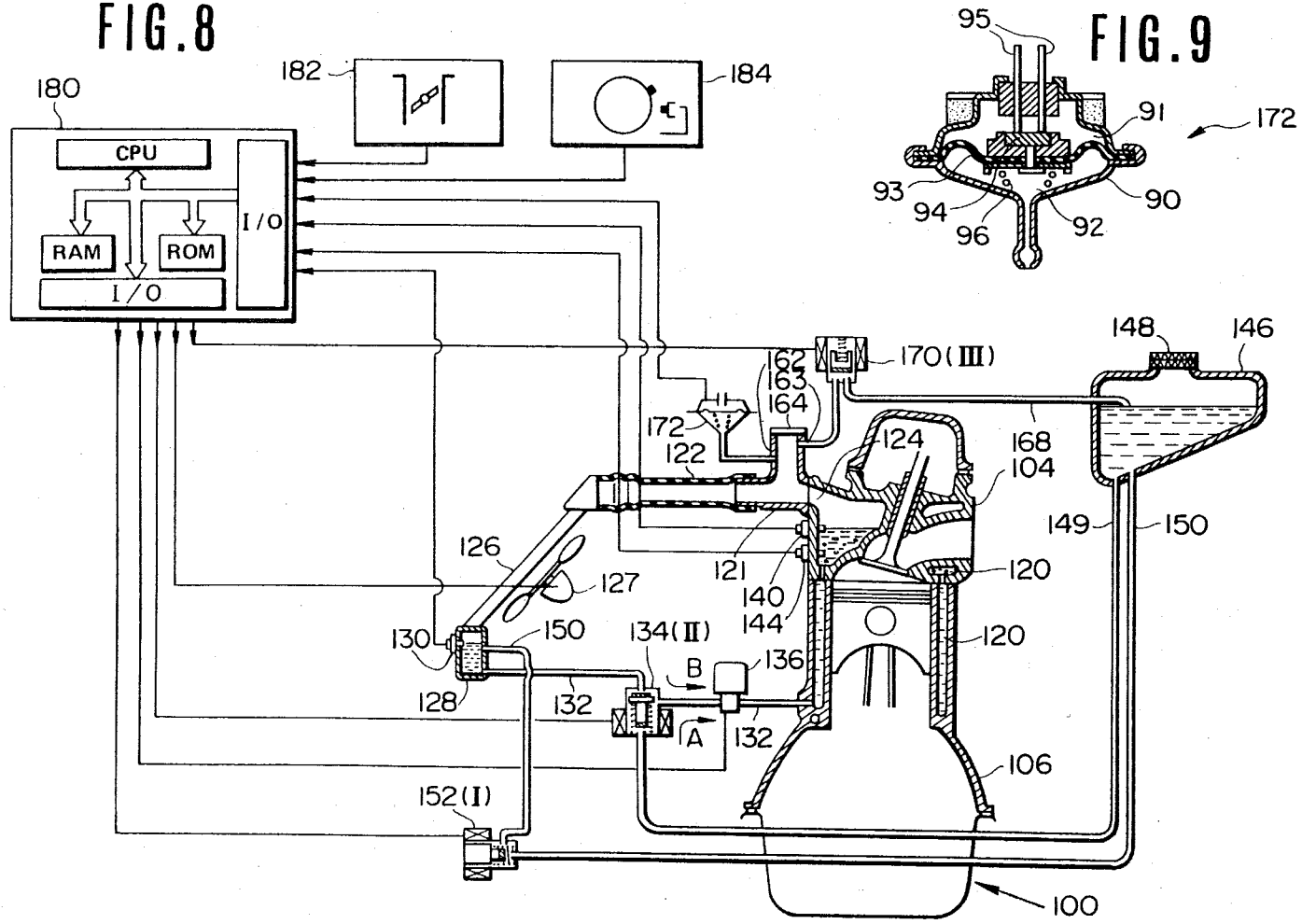
FIG. 8 shows in sectional elevation an engine system which embodies the present invention.
FIG. 9 shows in sectional elevation the construction of a pressure differential responsive switch which may be utilized in the arrangement shown in FIG. 8.

FIG. 8 shows an engine system incorporating a first embodiment of the present invention. In this arrangement, an internal combustion engine 100 includes a cylinder block 106 on which a cylinder head 104 is detachably secured. The cylinder head 104 and cylinder block 106 include suitable cavities which define a coolant jacket 120 about the heated portions of the cylinder head and block.

A vapor manifold 121 and vapor transfer conduit 122 provide fluid communication between a vapor outlet port 124 formed in the cylinder head 104 and a radiator or heat exchanger (viz., condensor) 126.

It should be noted that the interior of the relatively small diameter conduits which define the actual heat exchanging surface of the radiator 126, are maintained essentially empty of liquid coolant (dry) during normal engine operation so as to maximize the surface area available for condensing coolant vapor (via heat exchange with the ambient atmosphere) and that the cooling circuit (viz., the circuit which in the illustrated embodiment includes the coolant jacket, radiator and conduiting interconnecting same) is hermetically closed when the engine is warmed-up and running. These features will become clearer as the description proceeds.

If deemed advantageous a mesh screen or like separator (not shown) can be disposed in the vapor discharge port 124 of the cylinder head so as to minimize the transfer of liquid coolant which tends to forth during boiling, to the radiator 126. Alternatively, cylinder head/manifold arrangements such as disclosed in U.S. Pat. No. 4,499,866 issued on Feb. 19, 1985 in the name of Hirano and U.S. patent application Ser. No. 642,369 filed in June 25, 1984 in the name of Hirano et al, can be employed if desired.

Located suitably adjacent the radiator 126 is a electrically driven fan 127. Defined at the bottom of the radiator 126 is a small collection reservoir or lower tank 128 as it will be referred to hereinafter. Disposed in the lower tank 128 is a level sensor 130 which is adapted to output a signal indicative of the level of liquid coolant in the lower tank 128 falling below same. Viz., being below a level selected to be lower than the lower ends of the tubing which consitute the heat exchanging portion of the radiator.

Leading from the lower tank 128 to the cylinder block 120 is a return conduit 132. As shown, a "three-way" type electromagnetic valve 134 and a relatively small capacity return pump 136 are disposed in this conduit. The valve 134 is located upstream of the pump 136. The return conduit 132 is arranged to communicate with the lowermost portion of the coolant jacket 120.

In order to sense the level of coolant in the coolant jacket and appropriately control the operation of the pump 136, a (first) level sensor 140 is disposed as shown. It will be noted that this sensor is arranged at a level higher than that of the combustion chambers, exhaust ports and valves (structure subject to high heat flux) so as to ensure that they are securely immersed in coolant and thus attenuate any engine knocking and the like which might otherwise occur due to the formation of localized zones of abnormally high temperature of "hot spots".

Located below the level sensor 140 so as to be immersed in the liquid coolant is a temperature sensor 144.

A coolant reservoir 146 is located beside the engine proper as shown. In this embodiment the reservoir is advantageously disposed at a relatively high position with respect to the engine so that a gravity feed effect is obtained. It should be noted however, that if the engine layout so demands, the reservoir can be located in positions other than the illustrated one and that the present invention is not limited to same.

An air permeable cap 148 is used to close the reservoir 146 in a manner that atmospheric pressure continuously prevails therein.

The reservoir 146 fluidly communicates with the "three-way" valve 134 via a supply conduit 149 and with the engine coolant jacket 120 via a displacement-/discharge conduit 150 and an ON/OFF type electromagnetic valve 152. This valve is closed when energized. As shown, the conduit 150 communicates with the lower tank 128 at a location essentially level with the second level sensor 130.

The vapor manifold 121 includes a riser-like portion 162 in which a "purge" port 163 is formed. A cap 164 hermetically closes the riser 162. Port 163, as shown, communicates with the reservoir 164 via an overflow conduit 168. A normally closed electromagnetic valve 170 is disposed in the overflow conduit 168. This valve is opened when energized.

In order to sense the pressure prevaling within the cooling circuit, a sensor 172 which is responsive to the pressure differential between the pressure prevailing in the cooling circuit and that of the ambient atmosphere is arranged to communicate with the riser 162.

The above mentioned level sensors 130 & 140 may be of any suitable type such as float/reed switch types.

As shown, the outputs of the level sensors 130 & 140, temperature sensor 144 and pressure differential sensor 172 are fed to a control circuit 180. In this embodiment the control circuit 180 includes therein a microprocessor including input and output interfaces I/O a CPU, a RAM and a ROM. Suitable control programs are set in the ROM and are used to control the operation of the valves 134, 152 & 170, pump 136 and fan 127 in response to the various data supplied thereto.

In order that the temperature of the coolant be appropriately controlled in response to changes in engine load and speed, a load sensor 182 and an engine speed sensor 184 are arranged to supply data signals to control circuit 180. The load sensor may take the form of a throttle position switch which is triggered upon the engine throttle valve being opened beyond a predetermined degree; alternatively the output of an air flow meter of an induction vacuum sensor may be used. The engine speed signal may be derived from the engine distributor, a crankshaft rotational speed sensor or the like.

FIG. 9 shows an example of the pressure differential responsive sensor 172 used in the illustrated embodiment. In this arrangement a casing 90 is divided into an atmospheric chamber 91 and a pressure chamber 92 by a flexible diaphragm 93. A suitable contact 94 is mounted in the center of the diaphragm 93 and arranged to provide electrical connection between a pair of electrodes 95 which are arrange to protruded into the atmospheric chamber 91 of the device. A spring 96 having a preselected bias is disposed in the pressure chamber 92 and arranged to bias the diaphragm 93 in a direction which brings the contact 94 into engagement with the electrodes 95. The spring 96 is selected so that when a pressure which is lower than atmospheric by a predetermined amount prevails within the cooling circuit the diaphram 93 deflects in a manner which brings the contact 94 out of engagement with the electrodes 95 and thus opens the circuit. This is used as an indication that a negative pressure of a predetermined magnitude has developed within the system and it is either possible or necessary (depending on the instant mode of engine operation) to the place the cooling circuit in an "open" condition. A filter element 97 is disposed as shown to prevent the entry of dust and the like into the atmospheric chamber 91.

Prior to initial use the cooling system is completely filled with coolant (for example water or a mixture of water and antifreeze or the like) and the cap 164 securely set in place to seal the system. A suitable quantity of additional coolant is also placed in the reservoir 146. Although at this time, by using de-aerated water when initially filling the system and reservoir, the system is essentially free of contaminating air etc., over a period of time non-condensible matter will find its way into the system. For, example the coolant (e.g. water) in the reservoir will tend to absorb atmospheric air and each time the system is filled with coolant to as to obviate any negative pressures and exclude the entry of air, a little non-condensible matter will tend to find its way into the system. Further, during given modes of engine operation, slightly negative pressures develop and although the system is operating in a sealed or closed mode at the time, air, little by little, tends to leak into the system via the gasketing and the like defined between the cylinder head and cylinder block and between the seals defined between conduiting and associated elements of the system.

Accordingly, upon start-up of the engine, given that the engine temperature is blow a predetermined value (45° C. for example) a non-condensible matter purge operation is carried out. In this embodiment the purge operation is effected by pumping coolant into the system for a predetermined period of time. As the system should be essentially full of coolant at this time, the excess coolant thus introduced positively displaces any air or the like the might have collected.

Figure 10:
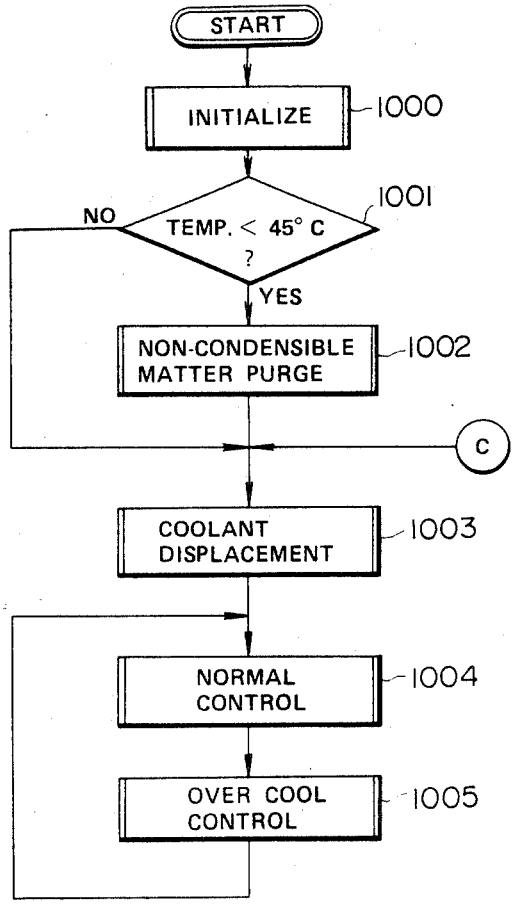
FIGS. 10–16 are flow charts showing the steps which characterize the control operations of an embodiment of the present invention.

FIG. 10 shows the characterizing steps executed by the microprocessor (control circuit 180) during what shall be termed a "system control routine". As shown, subsequent to the start of this program, the system is initialized (step 1000). Following this it is determined in step 1001 whether the temperature of the engine coolant is greater than 45° C. If the outcome of this enquiry shows that the coolant is still cold (viz., below 45° C.) then the program proceeds to step 1002 wherein a "non-condensible matter purge routine" is effected. If the temperature of the coolant is above 45° C., then the engine is deemed to be "hot" and the program by-passes the purge routine and effects what shall be termed a "hot start". In the event that the purge routine is carried out, the system is considered as undergoing a "cold start".

At step 1003, the program enters a "coolant displacement routine" wherein the coolant which fills the radiator and coolant jacket is displaced under the influence of the pressure which develops within the system when the coolant has been heated sufficiently. Upon the excess coolant being displaced from the system to the reservoir 146, the program goes on to enter a normal "control routine" (step 1004).

In the event that, due to uncontrollable circumstances such as occurs during very cold weather or during prolonged downhill coasting, the pressure within the system falls below that at which the temperature of the coolant cannot be held at a sufficiently high level or at which crushing of various components of the cooling system by the external pressure is apt to occur, the program proceeds to an "overcool control routine" at step 1005. Upon exiting from this routine the program returns, as shown, back to the "normal control".

Upon the engine being stopped a "shut-down control routine" (see FIG. 11) is executed. This routine as shown, includes an interrupt (step 2001) which breaks into the program which is currently being run and proceeds to at step 2002 enter a routine which continues to control the system after the engine is stopped and the ignition switch is opened, until the system enters a state whereat switching from closed to open states is possible without violent discharge of coolant.

Each of the above mentioned routines will now be set forth in more detail.

Non-condensible matter purge routine

Figure 12:
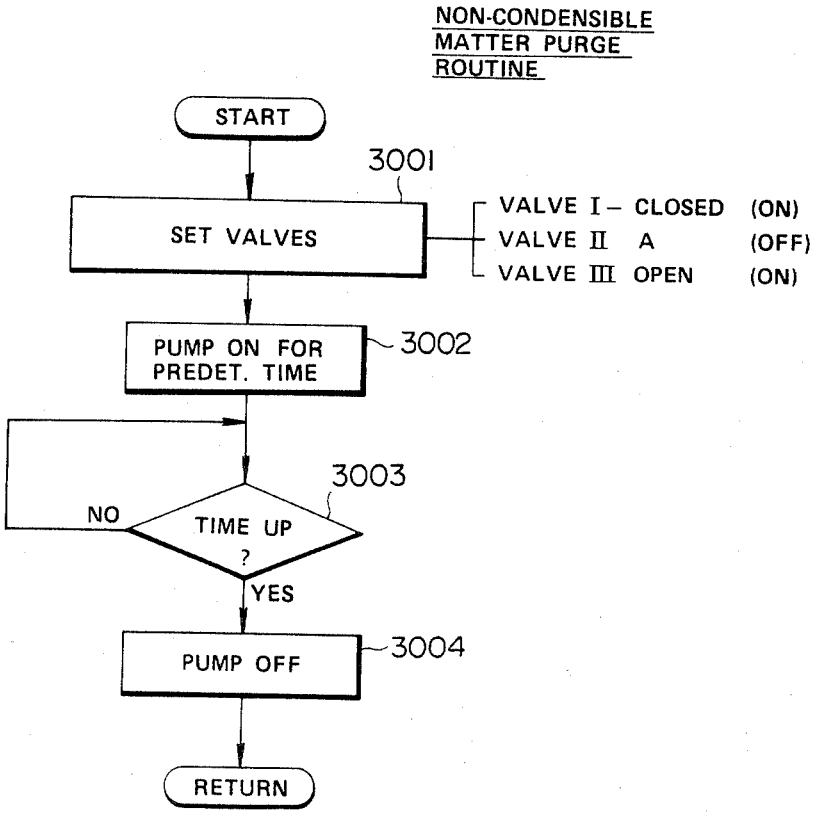

FIG. 12 shows a flow chart depicting the steps which characterize the control executed during the "non-condensible matter purge routine". As shown, subsequent to START the program proceeds in step 3001 to condition the valves of the system so that valve I (152) is energized so as to assume a closed state, valve II (134) is de-energized so as to establish flow path A (viz., fluid communication between the reservoir 146 and the coolant jacket 120) and valve III (170) is energized so as to assume an open condition and thus establish fluid communication between the riser of the vapor manifold and the reservoir 146 via conduit 168. With the valve and conduit arrangement of the present invention thus conditioned, energization of the pump 136 for a predetermined period of time (10 seconds–1 minute by way of example only) in step 3002, inducts coolant from the reservoir 146 and forces same into the coolant jacket 120 via conduit 132. As the cooling circuit should be essentially full at this time, this brief energization of the pump 134 forces sufficient additional coolant into the system as to ensure that any traces of non-condensible matter (air or the like) are purged out of the system and forced to flow along with the excess coolant via valve III (170) back to reservoir 146 via overflow conduit 168. At step 3003 the program determines if a timer arrangement which will be referred as being a first timer or timer (1), included in the microprocessor (a software timer by way of example) and which is triggered by the operation of the pump in step 3002, has counted up to the predetermined period of time or not. If the answer to the enquiry carried out in this step is negative, then the program recycles as shown until a positive result is obtained. At step 3004 the operation of the pump is stopped and the purge routine terminates.

Excess coolant displacement routine

Following either the purge of non-condensible matter via overfilling the cooling circuit with coolant or a "hot" start wherein the cooling circuit is only partially filled with coolant, the system control proceeds into an "excess coolant displacement routine" (FIGS. 13A & 13B) wherein the temperature of the coolant is permitted to increase to the point of producing vapor pressure, and this pressure used to displace coolant from the circuit until a predetermined desired amount of coolant remains.

The first step (4001) of this control process takes the form of setting three electromagnetic valves of the valve and conduit arrangement as shown. Viz., a situation wherein valve I is energized to assume an open condition, valve II energized to establish flow path B between the lower tank 128 and the coolant jacket 120 while the valve III is de-energized to assume a closed condition.

At step 4002 an enquiry is carried out to determine if the level of coolant in the lower tank 128 is lower than the "second" level sensor 130 disposed therein. If the outcome of this enquiry indicates that the level of coolant has not yet fallen thereto, then at step 4003 the operation of fan 127 is prevented and subsequently valve I opened (step 4004) so as to permit the discharge of some of the excess coolant out to the reservoir 146. On the other hand, if the level of the coolant in the lower tank 128 has fallen to that of the second level sensor 130 then the program goes to step 4005 wherein it is determined if the pressure in the cooling circuit is lower than atmospheric pressure. In the event that the pressure within the system is lower than that of the ambient atmosphere by an amount sufficient to trigger the pressure differential responsive sensor 172 then the program again flows to steps 4003 and 4004 whereat the operation of the fan stopped so as to prevent further development of the sub-atmospheric pressure and valve I opened (in this case to permit the induction of coolant from the radiator).

However, if the pressure within the cooling circuit is super-atmospheric then at step 4006 valve I (152) is energized to close same and cut-off fluid communication between the coolant circuit and the reservoir 146. This step prevents the possibility that as the level of coolant in the lower tank is below that of sensor 130, coolant vapor may be vented to the atmosphere through conduit 150.

Figure 1:
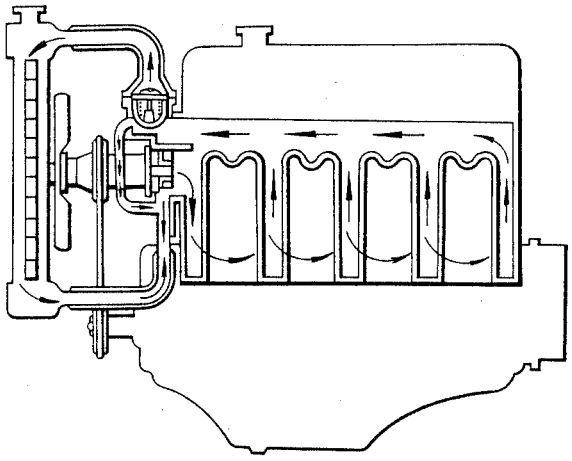
FIG.1 (PRIOR ART)
FIG. 1 is a partially sectioned elevation showing a currently used conventional water circulation type system discussed in the opening paragraphs of the instant disclosure.
Figure 2:
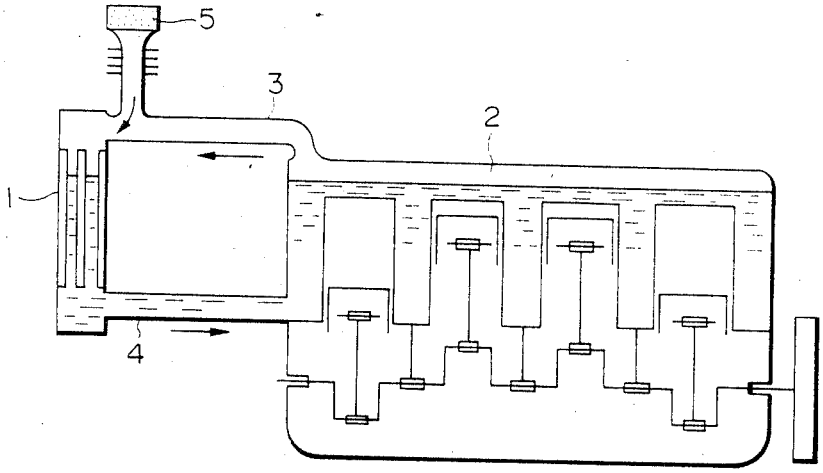
FIG.2 (PRIOR ART)
FIG. 2 is a schematic side sectional elevation of a prior art arrangement also discussed briefly in the earlier part of the specification.
Figure 3:
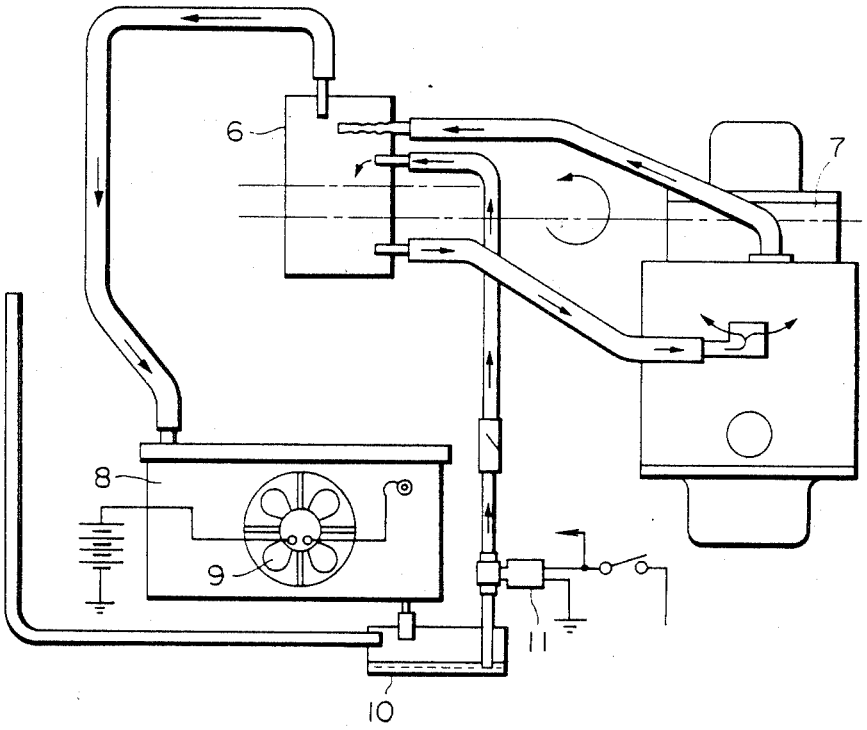
FIG.3 (PRIOR ART)
FIG. 3 shows in schematic layout form, another of the prior art arrangements previously discussed.
Figure 4:
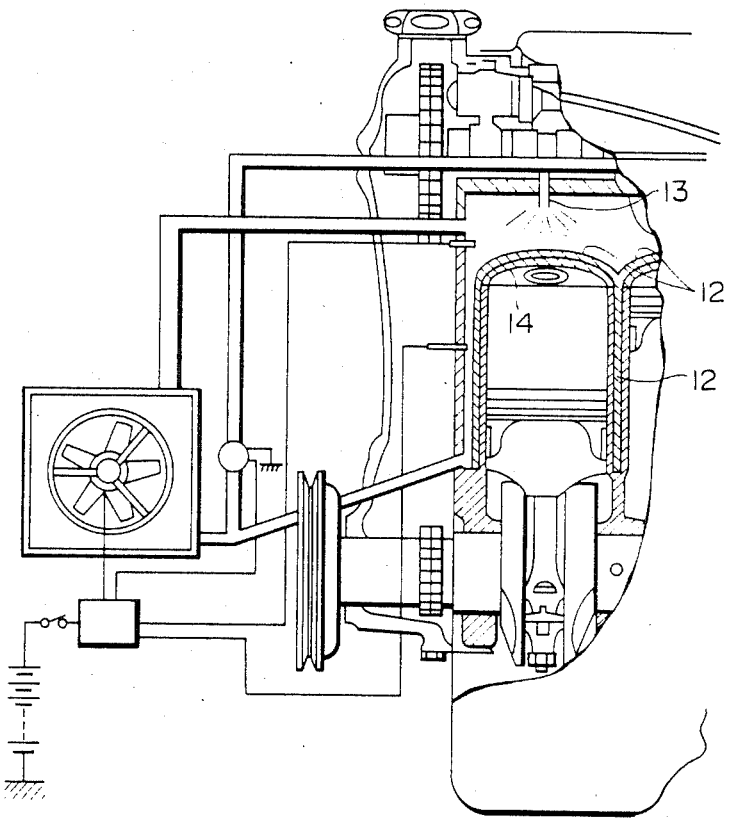
FIG.4 (PRIOR ART)
FIG. 4 shows in partial section yet another of the previously discussed prior art arrangements.
Figure 5:
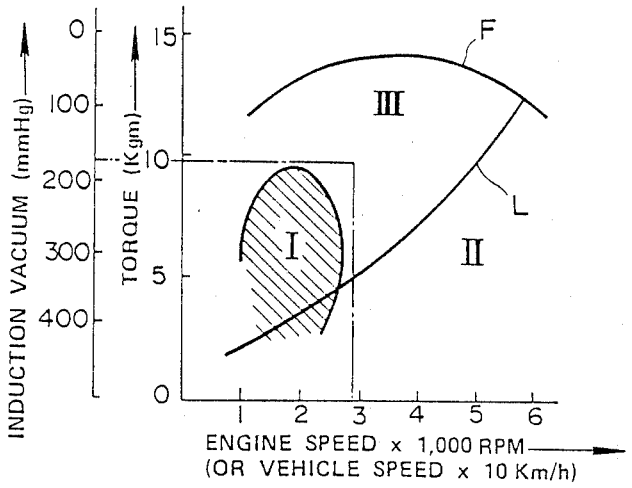
FIG. 5 is a graph showing, in terms of engine torque and engine/vehicle speed, the various load zones encounted by an automotive vehicle.

Subsequently at step 4007 the target temperature (viz., the temperature most appropriate for the instant mode of engine operation) is determined. This step can be executed by setting a two-dimensional table of the nature shown in FIG. 5 into the ROM of the microprocessor and using the data inputs from the engine load and speed sensors 182 and 184 to determine via table look-up the appropriate temperature for the instant operational conditions. Alternatively, a suitable program which calculates the appropriate or target temperature in view of the magnitude of said inputs can be used. The various different ways in which this particular determination can be executed will be apparent to those skilled in the art of programming and as such no further description will be given for brevity.

At step 4008 the instant coolant temperature is compared with the target value derived in step 4007. In the event that the instant temperature is within a range of (Target Temp$+a_1$)$-$(Target Temp$-a_2$) (where in the instant embodiment $a_1=0.5°$ C. and $a_2=0.5°$ C.) then the fan control operations contained in steps 4009 and 4010 are by-passed. In the event that the instant temperature is above a value of Target Temp$+a_1$ then the fan 127 is energized to increase the rate heat exchange between the ambient atmosphere and the radiator surface and thus the rate of condensation within the radiator 126. This of course tends to lower the pressure within the system and thus the temperature at which the coolant in the coolant jacket 120 boils. In the event that the instant temperature at which the coolant is boiling is detected as being lower than Target Temp$-a_2$, then the fan is stopped to reduce the rate of condensation and thus induce an increase in the boiling point of the coolant.

At step 4011 it is determined if the level of coolant within the coolant jacket is lower than the first level sensor 140. In the event of a negative result (that is the level is above the first sensor) then the program recycles to step 4002. On the other hand, in the vent of a positive result the fan is stopped (step 4012).

At step 4013 (FIG. 13B) an enquiry is made as to whether valve I is open or not. If the outcome of this enquiry reveals that the valve is still open, then the program proceeds to step 4014 wherein it is determined if the level of coolant in the coolant jacket is below level sensor 140 or not. If the result of this enquiry is positive pump 136 is energized at step 4015 while in the event of a negative result the operation of the pump is stopped at step 4016. Susequently, at step 4017 the level of the coolant in the lower tank is sampled. If the level is above level sensor 130 the program recycles to step 4014 while in the event that the level is in fact lower than level sensor 130 then at step 4018 valve I is closed. After this the program returns.

As will be appreciated, the steps executed in this control routine are such as to permit the coolant be driven out of the cooling circuit under the influence of the increasing vapor pressure therein while simultanously maintaining the level of coolant within the coolant jacket 120 at that of the "first" level sensor 140.

Figure 13A:
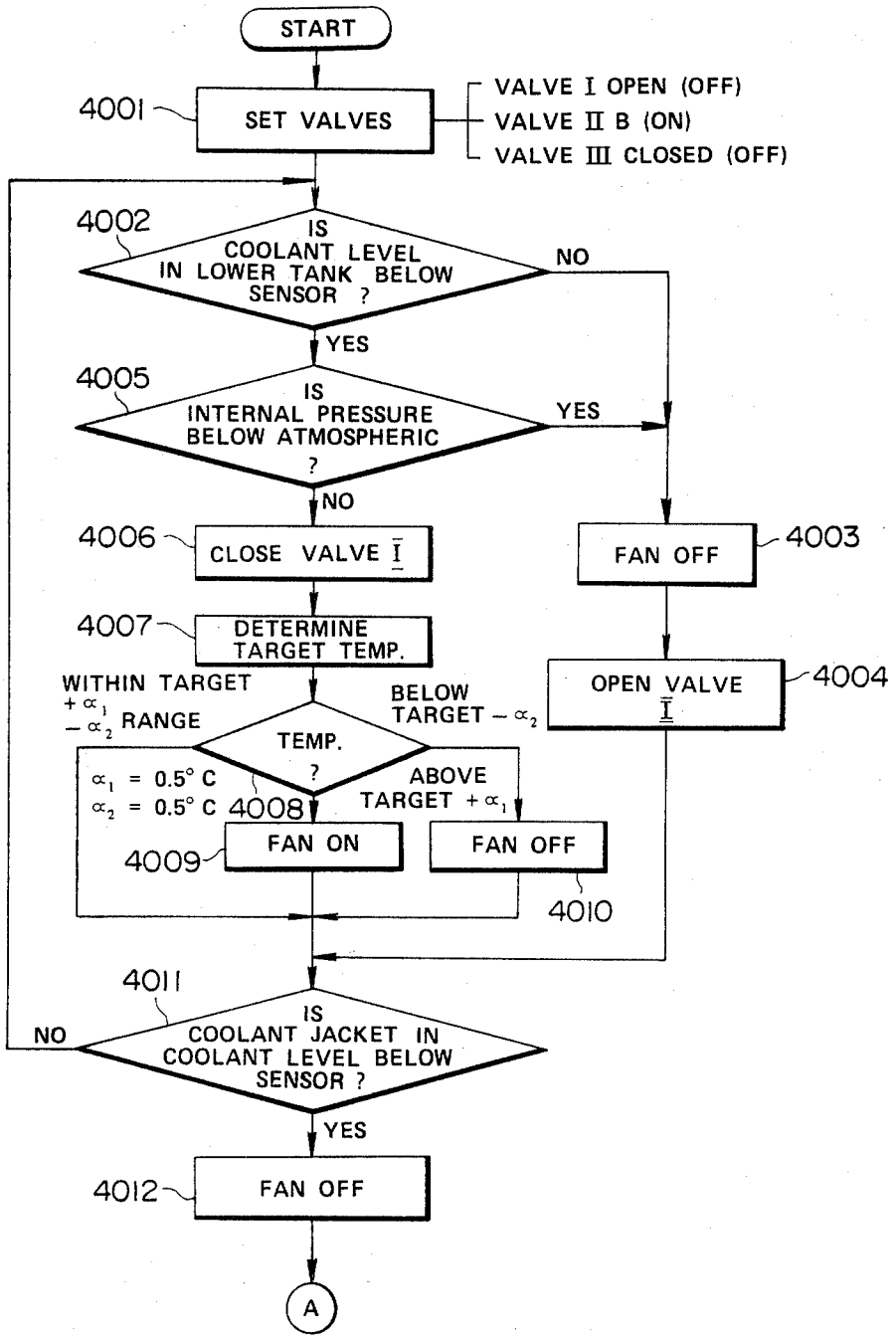

However, it should be noted that experience has shown that during so called hot starts (wherein the coolant jacket is only partially filled with liquid coolant) the displacement of coolant tends to be such that the level of coolant in the coolant jacket falls to that of the level sensor 140 before the level in the radiator falls to that of level sensor 130. On the other hand, in the case of a "cold" start where the coolant jacket is completely filled with liquid coolant the level of coolant in the radiator tends to fall to that of level sensor 130 before the level in the coolant jacket drops to that of level sensor 140. Accordingly, the steps set forth in FIG. 13A are arranged so that in the event that the coolant level falls to that of level sensor 140 first, the program flows on to the steps shown in FIG. 13B while in the event that the radiator tends to be emptied first, then the steps shown in FIG. 13A are repeatedly executed (via recycling between steps 4001 and 4011) so that the coolant in the coolant jacket is moved to the radiator in the form of vapor and valve I repeatedly opened and closed (steps 4003 and 4006) to permit the coolant transfered from the coolant jacket to the radiator to be removed little by little.

It should be further noted that during this phase of operation the engine is controlled (steps 4007–4010) in a manner to maintain the appropriate target temperature and/or open the circuit and allow the induction of coolant into the cooling circuit should a negative pressure develop and thus obviate any possiblity of "overcooling" during the displacement mode. It will be noted that the overcool control and the displacement of coolant are controlled by the same steps (steps 4003, 4004) depending on the pressure prevailing in the system.

Retained coolant check/control routine

As previously mentioned, it is possible that either too much or too little coolant will be retained within the cooling circuit at the time it is placed in a closed state. Accordingly, the present invention provides for the amount of coolant entrapped within the system to be periodically monitored and if an inappropriate amount of coolant is determined to be within the system, then steps are taken to correct the situation.

Figures 13B, 14B:
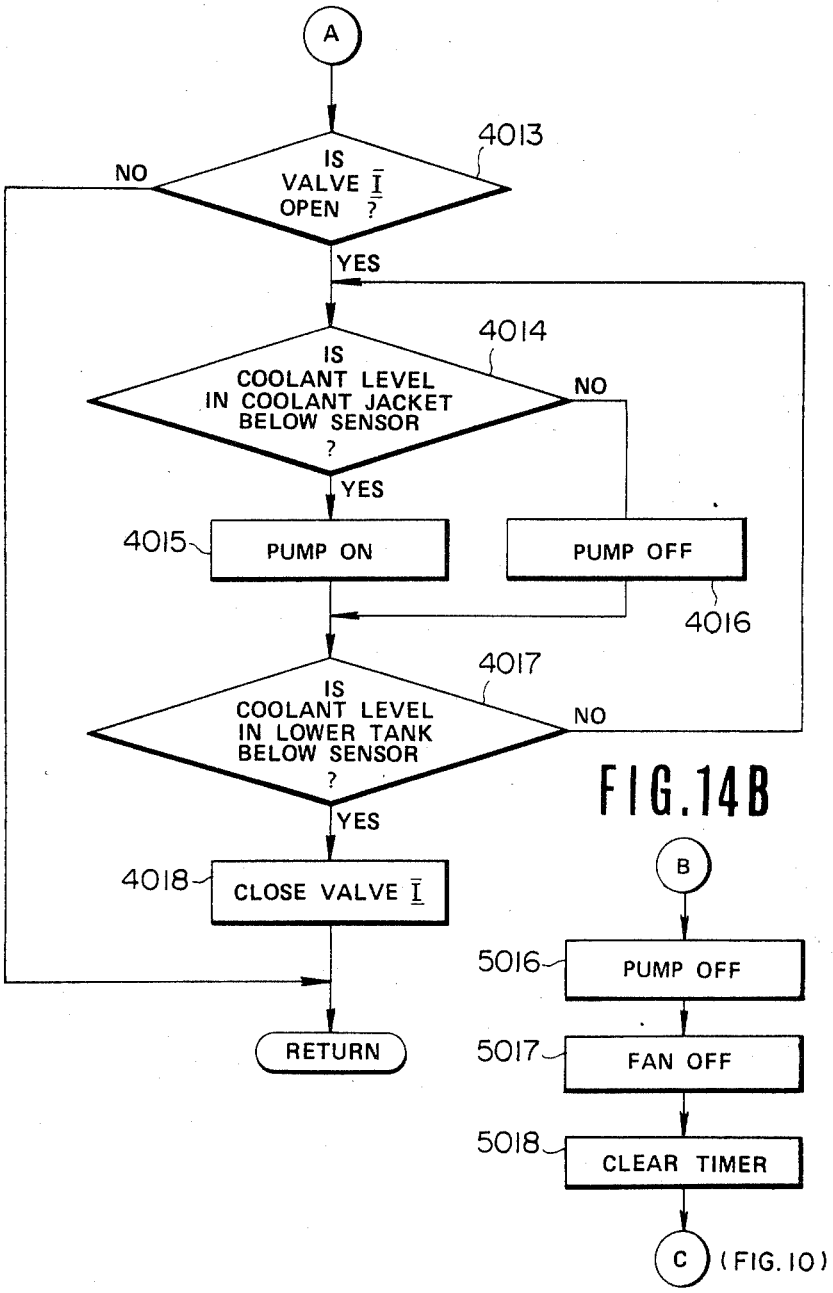
Figure 14A:
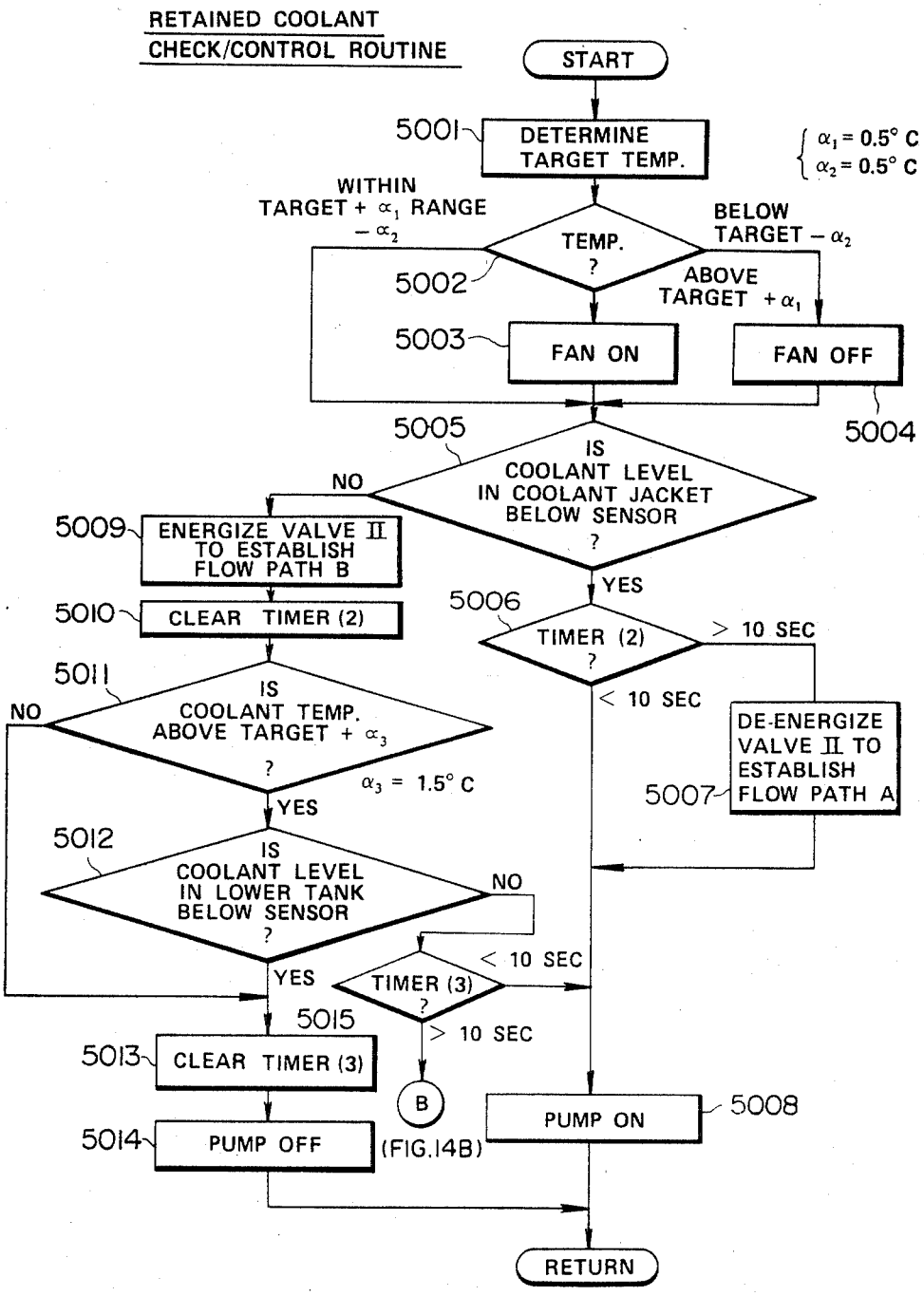

An example of a "monitoring" program which can be run at predetermined intervals is shown in FIGS. 14A and 14B. As shown, subsequent to this program being started, the most appropriate temperature for the instant set of operational conditions (Viz., Target Temp) is determined at step 5001 whereafter an enquiry as to the instant coolant temperature is carried out by sampling the output of temperature sensor 144. The temperature of the coolant is accordingly adjusted by selectively energizing or stopping the energizing of fan 127 in steps 5003 and 5004 in a manner similar to that set forth in connection with steps 4008–4010 in the excess coolant displacement routine (FIG. 13A).

At step 5005 the output of the level sensor 140 is sampled to determine if the level of coolant in the coolant jacket is above or below the same.

In the event that the coolant level is determined as being below sensor 140 then at step 5006 a software timer (by way of example) which shall be referred to as a "second" timer or timer (2) is read and a determination made as to how long the level of coolant within the coolant jacket has remained below that of level sensor 140. This measurement may be taken from the time for which the pump is operated in order to restore the level of coolant jacket (that is to say, return the coolant which is continuously being boiled and transmitted in the form of coolant vapor to the radiator 126). In this embodiment if the coolant level has remained below that of level sensor 140 for more than 10 seconds then at step 5007 it is assumed that insufficient coolant is retained within the cooling circuit and valve II (134) is de-energized to establish flow path A between the reservoir and the coolant jacket. At step 5008 pump 136 is energized to pump additional coolant into the system and thus bring the amount of coolant within the cooling circuit up to that required.

On the other hand, if the outcome of the enquiry at step 5005 is negative—viz., the level of coolant within the coolant jacket is not below sensor 140 then the program flows to step 5009 wherein valve II is energized to establish flow path B (viz establish fluid communication between the lower tank 128 and the coolant jacket 120). At step 5010 timer (2) is cleared. At step 5011 it is determined if the temperature of the coolant in the coolant jacket 120 is above a temperature of Target Temp$+a_3$ (where $a_3=1.5°$ C.)Viz., at this step it is determined if the temperature is above the previously described control range required under the instant set of operational conditions. If the answer is NO then the program bypasses step 5012 and proceeds directly to step 5013 wherein a third software timer or timer (3) is cleared. Subsequent to step 5013 the operation of the pump is stopped in step 5014. However, in the event that the answer to the enquiry made at step 5011 is YES and the temperature is sensed as being higher than the aforementioned level—which indicates the possible presence of an excessive amount of coolant within the cooling circuit—then at step 5012 it is determined if the level of coolant in the lower tank is in fact above level sensor 130. If the level is below said sensor, then the program flows to step 5013. However in the event that the level not lower than level sensor 140, then the program goes to step 5015 wherein it is determined if the third timer (timer (3)) has counted up to a predetermined level (in this embodiment the equivalent of 10 seconds). If the third timer has clocked up a time of greater than 10 seconds then the program flows to steps 5016 to 5018 (FIG. 14B) wherein the pump and fan are stopped and the third timer cleared. Following step 5018 the program flows to step 1003 (shown in FIG. 10) wherein the excess coolant displacement routine (shown in detail in FIGS. 13A and 13B) are re-implemented). This of course removes the excess coolant from the system which induced the undesireably high temperature (detected in step 5011 of the retained coolant check/control routine.

However, if the time sampled at step 5015 is less than 10 seconds, then the program flows across and down to step 5008 wherein the operation of pump 136 is stopped.

Overcool control routine

In the event that due to external influences which cannot be controlled merely by stopping the operation of fan 127, the rate of condensation within the radiator 126 exceeds that at which the desired Target Temp can be maintained, then it is necessary in order to prevent excessively low internal pressures which lower the boiling point of the coolant and/or possibly induce damage to the cooling circuit itself, to switch the system to an open state so as to induct coolant into cooling circuit in a manner which partially floods the heat exchanging conduiting of the radiator and thus reduces the surface area available for the coolant vapor to release its latent heat of evaporation.

Figure 15:
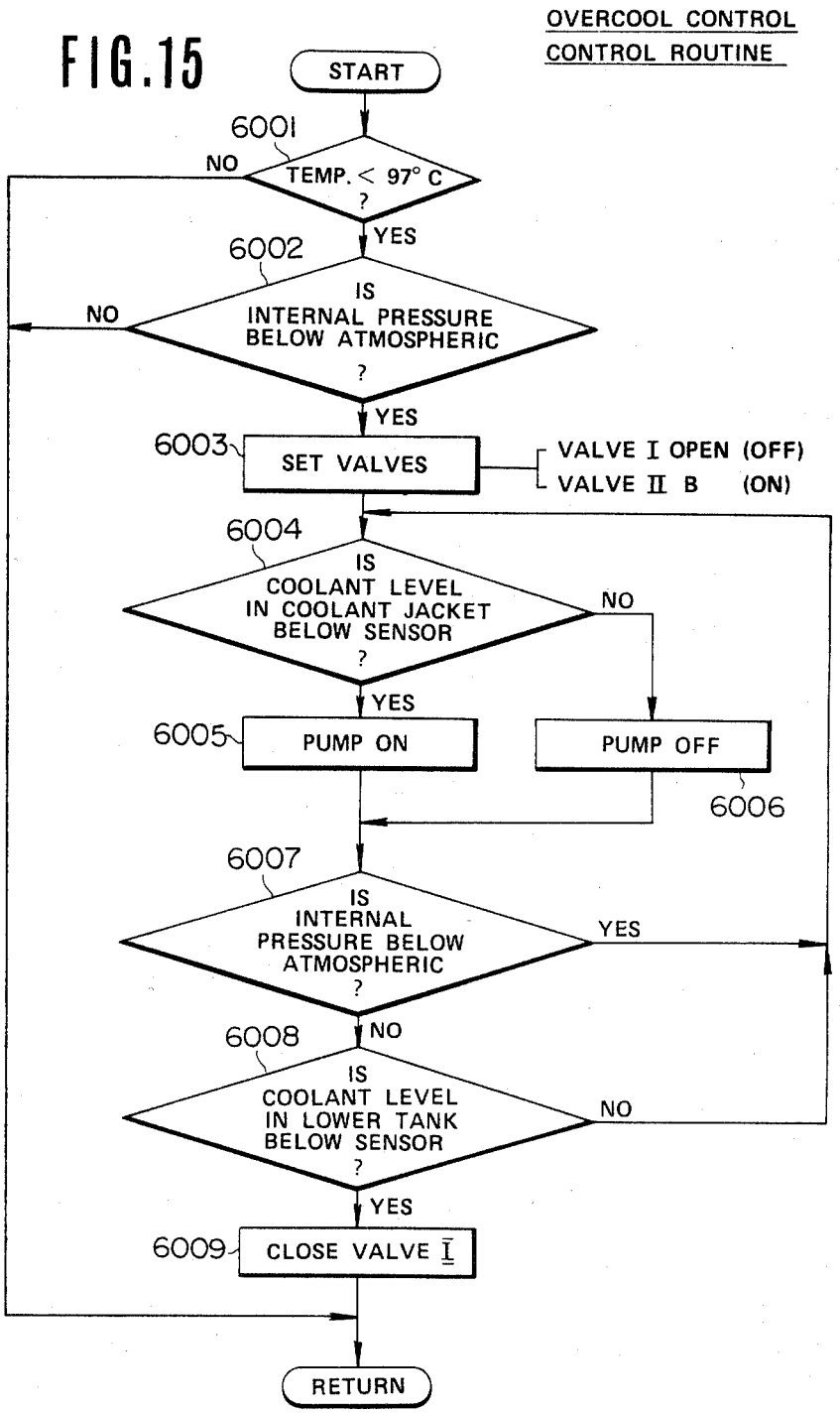

FIG. 15 shows a flow chart which depicts the control exercised during the above mentioned mode of operation.

After the START of the program the output of the temperature sensor 144 is sampled and a determination made as to whether the coolant temperature is above 97° C. or not. In the event that the temperature is above said level the program flows to RETURN and thus terminates. However, if the temperature is determined to be lower than 97° C. then at step 6002 the output of the pressure sensor 172 is sampled and a determination made as to whether the pressure prevailing in the cooling circuit is below the predetermined level at which diaphragm 93 flexes and brings contact contact 94 out of engagement with electrodes 95. If a negative pressure of the just mentioned level has not yet developed then the program flows to RETURN whereat the instant run terminates. However, if the pressure has fallen below the level at which the switch defined by the contact 94 and electrodes 95 is opened then as both the pressure and temperature within the cooling circuit are lower than desired, the program goes to step 6003 whereat the valves of the valve and conduiting arrangement are conditioned as shown. Viz., valve I is de-energized to assume an open condition and thus "open" the cooling circuit and valve II is energized to establish flow path B. Valve III (170) is maintained de-energized (closed).

At step 6004 the output of level sensor 140 is sampled to determine if the level of coolant within the coolant jacket is lower than that desired. In the event that the coolant level is below that of level sensor 140 then as step 6005 pump 136 is energized. On the other hand, if a sufficient amount of coolant is present in the coolant jacket 120 then the operation of the pump is stopped. These steps of course ensure that the desired level of coolant is maintained within the coolant jacket despite the system being temporarily placed in an "open" condition.

At step 6007 the pressure prevailing within the system is again sampled and in the event that the pressure remains below the lower acceptable limit then the program recycles to step 6004. However, if the pressure has come up to an acceptable level then at step 6008 the level of coolant in the lower tank 128 is determined by sampling the output of sensor 130. In the event that the level of coolant is still above that of sensor 130 then the program recycles back to step 6004. However, if the level of coolant has fallen to that of level sensor 130 then it is deemed that the inducted excess coolant has been displaced under the influence of the re-developed pressure and that overcool control can be terminated and the system to be returned to a closed state. Accordingly, in step 6009 valve I is energized to close and thus seal the system.

As will be appreciated, with the control provided during this mode of operation, until both of the pressure and temperature are determined to below acceptable levels for the given operation conditions (viz, ambient atmospheric pressure and engine operational load etc.,) then the system will not be switched to an open state thus ensuring that large volumes of coolant will not be suddenly discharged due to superatmospheric pressures.

Shut-down control routine

When the engine is stopped it is necessary to control the system for a short period to ensure that superatmospheric pressures will not cause violent discharging of hot coolant out of the system to the reservoir.

Figure 11:
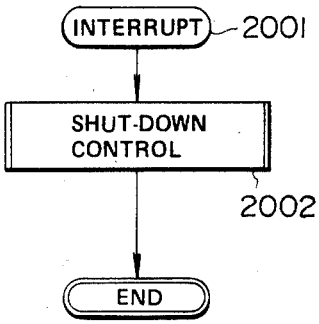
Figure 16:
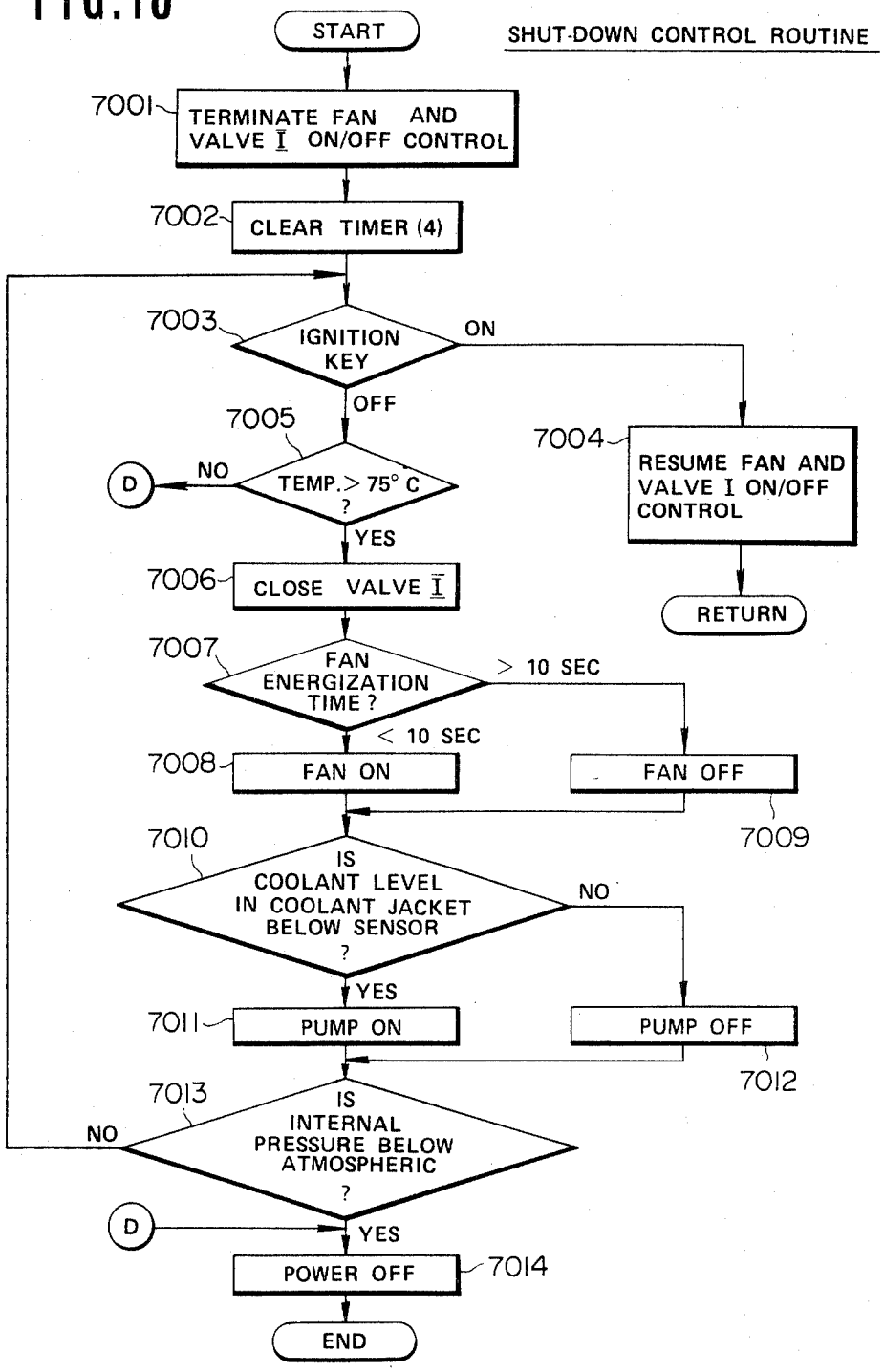

FIG. 16 shows in flow chart form the control exercised during what shall be termed the shut-down mode of operation. As shown in FIG. 11 this program is implemented after an interrupt is carried out to break into the program being currently run in the CPU of the microprocessor in response to the stoppage of the engine. This may be determined by sampling the output of the engine speed sensor 184.

The first step of the shut down control involves terminating all current fan and valve I ON/OFF controls. At step 7002 a fourth timer is cleared ready for timing the operations of the shut-down. At step 7003 the status of the engine ignition switch is determined. That is to say, to determine between an accidental stalling of the engine and an intentional stoppage of the engine. If the switch is ON, then it is assumed that the engine has not been deliberately stopped and the program flows to step 7004 wherein the ON/OFF control of the fan and valve I terminated in step 7001 is restored.

However, if it is determined that the engine has been deliberately stopped by switching the engine off, then the program flows to step 7005 wherein the output of temperature sensor 144 is sampled. If the temperature of the coolant is found to be less than 75° C. then the program immediately flows to step 7014 wherein the supply of electrical power to the entire system is terminated. However, if the temperature of the coolant is still above 75° C. then at step 7006 a command is issued which closes or maintains closed valve I. Subsequently, at step 7007 the time for which fan 127 has been maintained operative after the positive determination that the engine has been deliberately stopped, as determined by timer (4). When the fan is determined to have been continuously energized for ten seconds (by way of example only) the operation thereof is terminated (step 7009) and the program flows to step 7010 wherein the level of coolant within the coolant jacket is determined by sampling the output of level sensor 140. As shown in steps 7011 and 7012, the desired level is maintained to ensure that the highly heated structure of the engine is securely immersed in sufficiently coolant as to allow for the thermal inertia resulting from the heat capacity of the cylinder head, cylinder block etc.

At step the pressure within the system is sampled. If still above that at which the pressure differential sensor 172 is triggered then the program recycles to permit further cooling to take place. However, in the event that the pressure within the cooling circuit has fallen below that at which the pressure differential responsive sensor 172 switches, then the program flows to step 7014 whereat shut-down is completed and the system conditioned so that coolant is permitted to be induced into the cooling circuit under the mild negative pressure which has developed therein and to continue to be inducted as the temperature of the system continues to fall and the vapor continues to condense.

What is claimed is:

1. A cooling system for an internal combustion engine comprising:

a coolant jacket formed about structure of said engine subject to high heat flux;

a radiator in which coolant vapor is condensed to its liquid form;

a vapor transfer conduit leading from said coolant jacket to said radiator;

means for returning liquid coolant from said radiator to said coolant jacket in a manner to maintain said structure subject to high heat flux immersed in liquid coolant and define a vapor collection space within said coolant jacket;

a reservoir containing liquid coolant;

valve and conduit means for selectively establishing fluid communication between said coolant jacket and said reservoir;

valve and conduit control means including circuitry for:

(a) conditioning said valve and conduit means so as to establish fluid communication between said reservoir and a cooling circuit which includes said coolant jacket, said radiator and said second vapor transfer conduit, when the temperature of the coolant within said coolant jacket is below a first predetermined level and the pressure prevailing within said cooling circuit is below ambient atmospheric pressure by a second predetermined amount;

(b) conditioning said valve and conduit means so as to introduce excess coolant from said reservoir into said cooling circuit when the engine is started and the temperature of the coolant in said coolant jacket is below a third predetermined level and thus purge out any non-condensible matter in said cooling circuit;

(c) conditioning said valve and conduit means so as to permit coolant to be displaced from said engine under the influence of the vapor pressure produced within said cooling circuit when the engine is running and the temperature of said coolant is above said third predetermined level, and for terminating the displacement when said the amount of coolant contained in said cooling circuit has been reduced to a predetermined desired level; and (d) monitoring the operation of said liquid coolant returning means to determine if the correct amount of coolant has been retained in said cooling circuit and for conditioning said valve and conduit means to permit correction of the amount of coolant to said desired level.

2. A cooling system as claimed in claim 1, wherein said liquid cooling returning means takes the form of:

a first level sensor disposed in said coolant jacket at a level higher than said structure subject to high heat flux and lower than the uppermost portion of the said coolant jacket;

a pump which pumps liquid coolant from said radiator in response to said first level sensor indicating that the level within said coolant jacket is lower than same, said pump being disposed in a return conduit which leads from said radiator to said coolant jacket.

3. A cooling system as claimed in claim 2, further comprising:

a device associated with said radiator for varying the rate at which coolant vapor is condensed to liquid form in said radiator;

a second parameter sensor responsive to the temperature of the liquid coolant in said coolant jacket;

a third parameter sensor responsive to the pressure within said cooling circuit;

a fourth parameter sensor responsive to a parameter which varies with the load on the engine; and means responsive to said second and fourth parameter sensors for controlling said device in manner which tends to increase the temperature at which the coolant boils to a second predetermined temperature when the load on the engine is within a predetermined range and for controlling said device in a manner which tends to decrease the temperature at which the coolant boils to a third predetermined level when the load on said engine is outside said predetermined range.

4. A cooling system as claimed in claim 2, wherein said valve and conduit means includes:

a fill/discharge conduit which leads from said reservoir and communicates with a lower portion of said radiator;

a first valve disposed in said fill/discharge conduit, said first valve having a first position wherein communication is permitted between said radiator and said reservoir and a second position wherein communication between said radiator and said reservoir is prevented;

a supply conduit which leads from said reservoir and which communicates with said return conduit at a location upstream of said second pump;

a second valve disposed at the junction of said supply conduit and said return conduit and which in a first state establishes communication between said pump and said radiator via said return conduit and which in a second state establishes communication between said pump and said reservoir via said supply conduit;

an overflow conduit which leads from an upper section of the coolant jacket to said reservoir; and a third valve disposed in said overflow conduit, said third valve having a first normal position wherein communication between said coolant jacket and said reservoir is prevented and a second position wherein communication is established between said coolant jacket and said reservoir.

5. A cooling system as claimed in claim 3, further comprising:

a small collection tank formed at the bottom of said radiator, said small collection tank forming part of said coolant returning means; and a second level sensor disposed in said collection tank for sensing the level of coolant therein, said valve and conduit control means being responsive to the output of said second level sensor in a manner that when the coolant level falls thereto, said valve and conduit control means terminate the displacement of coolant out of said cooling circuit.

6. A method of cooling an internal combustion engine comprising the steps of:

introducing liquid coolant into a coolant jacket formed about structure of said engine subject to high heat flux in a manner to immerse said structure in a predetermined depth of liquid coolant;

allowing the liquid coolant in said coolant jacket to boil;

condensing the vapor produced by the boiling in said coolant jacket to its liquid form in a radiator;

transferring the coolant vapor from said coolant jacket to said radiator using a vapor transfer conduit;

returning liquid coolant from said radiator to said first coolant jacket using a coolant return arrangement in a manner to maintain said structure subject to high heat flux immersed in said predetermined depth of liquid coolant and define a vapor collection space within said coolant jacket;

storing additional coolant in a reservoir;

conditioning said valve and conduit means so as to establish fluid communication between said reservoir and a cooling circuit which includes said coolant jacket, said radiator and said second vapor transfer conduit, when the temperature of the coolant within said coolant jacket is below a first predetermined level and the pressure prevailing within said cooling circuit is below ambient atmospheric pressure by a second predetermined amount;

conditioning said valve and conduit means so as to introduce excess coolant from said reservoir into said cooling circuit when said engine is started and the temperature of the coolant in said coolant jacket is below a third predetermined level and thus purge out any non-condensible matter in said cooling circuit;

conditioning said valve and conduit means so as to permit coolant to be displaced from said engine under the influence of the vapor pressure produced within said cooling circuit when the engine is running and the temperature of said coolant is above said third predetermined level, and for terminating the displacement when the amount of coolant contained in said cooling circuit has been reduced to a predetermined desired level;

monitoring the operation of said liquid coolant returning arrangement to determine if the correct amount of coolant has been retained in said cooling circuit; and correcting the amount of coolant retained in said cooling circuit in the event that said step of monitoring reveals that the amount of coolant retained in said cooling circuit is not at a desired level.

7. A method as claimed in claim 6, wherein said step of returning comprises:

sensing the level of coolant in said coolant jacket using a first level sensor which is disposed in said coolant jacket at a level higher than said structure subject to high heat flux and lower than the uppermost portion of the said coolant jacket;

pumping liquid coolant from said radiator in response to said first level sensor indicating that the level within said coolant jacket is lower than said first level sensor, using a pump which is disposed in a return conduit which leads from said radiator to said coolant jacket.

8. A method as claimed in claim 7, further comprising the steps of:

varying the rate at which coolant vapor is condensed to liquid form using a device associated with said radiator;

sensing the temperature of the coolant in said coolant jacket using a second parameter sensor;

sensing the pressure in said cooling circuit using a third parameter sensor;

sensing the load on said engine using a fourth parameter sensor; and controlling said device using means responsive to said second and fourth parameter sensors in manner which tends to increase the temperature at which the coolant boils to a second predetermined temperature when the load on the engine is within a predetermined range and for controlling said device in a manner which tends to decrease the temperature at which the coolant boils to a third predetermined level when the load on said engine is outside said pedetermined range.

9. A method as claimed in claim 8, further comprising the steps of:

collecting the liquid coolant produced in said radiator using a small collection tank formed at the bottom of said radiator;

sensing the level of coolant in said collection tank using a second level sensor; and using the signal produced by said second level sensor to condition said valve and conduit means in a manner to terminate the displacement of coolant from said cooling circuit.

10. A method as claimed in claim 9, wherein said step of monitoring comprises:

adjusting the level of coolant in said coolant jacket to that of said first level sensor;

determining that the level of coolant in said coolection tank is above that of said second level sensor;

determining the time required for said coolant return means to transfer the coolant in said collection tank to said coolant jacket until the level in said collection tank falls to that of said second level sensor;

determining that an excess of coolant is retained in said cooling circuit if the time determined in said time determining step is in excess of a first predetermined time.

11. A method as claimed in claim 10, wherein said step of monitoring further comprises:

determing that the level of coolant in said coolant jacket is below said first level sensor;

determing the time for which said coolant transfer means operates to bring the level of coolant in said coolant jacket up to that of said first level sensor; and determining that insufficient coolant is retained in said cooling circuit if said coolant return means operates for a period in excess of a second predetermined period of time.

12. A method as claimed in claim 10 wherein said step of correcting includes:

determining that a superatmospheric pressure is prevailing within said cooling circuit;

conditioning said valve and conduit means to establish fluid communication between said cooling circut and said reservoir; and using said superatmospheric pressure to displace the excess coolant from said cooling circuit.

13. A method as claimed in claim 11, wherein said step of correcting includes:

conditioning said valve and conduit means to establish fluid communication between said cooling circuit and said reservoir; and conditioning said coolant return means to pump liquid coolant introduced thereinto by said valve and conduit means, into said coolant jacket until said first level sensor indicates that the level of coolant in said coolant jacket has risen thereto.

* * * * *